United States Patent [19]

Idenawa

[11] Patent Number: 4,814,816

[45] Date of Patent: Mar. 21, 1989

[54] DEVELOPING DEVICE

[75] Inventor: Hiroyuki Idenawa, Hiratsuka, Japan

[73] Assignee: Ricoh Company, Ltd., Tokyo, Japan

[21] Appl. No.: 874,104

[22] Filed: Jun. 13, 1986

[30] Foreign Application Priority Data

Jun. 27, 1985 [JP] Japan ..... 60-139144

[51] Int. Cl.[4] ..... G03G 15/08

[52] U.S. Cl. ..... 355/3 DD; 118/657; 355/15

[58] Field of Search ..... 355/3 R, 3 DD, 15; 118/657, 658, 660; 222/DIG. 1

[56] References Cited

U.S. PATENT DOCUMENTS

| | | | |
|---|---|---|---|
| 3,232,190 | 2/1966 | Willmott | 355/3 DD |
| 3,834,806 | 9/1974 | Whited | 355/3 DD |
| 3,953,121 | 4/1976 | Reichart | 118/658 X |
| 4,032,227 | 6/1977 | Hubbard et al. | 355/14 D |
| 4,297,026 | 10/1081 | Honda et al. | 355/15 |
| 4,339,196 | 7/1982 | Beck et al. | 355/3 DD |
| 4,405,226 | 9/1983 | Kimura et al. | 355/3 DD X |
| 4,410,259 | 10/1983 | Yamagata et al. | 355/3 DD |
| 4,439,034 | 3/1984 | Daniels | 355/3 DD |
| 4,583,832 | 4/1986 | Kasamura et al. | 355/3 DD |
| 4,640,608 | 2/1987 | Higaya et al. | 355/15 |

FOREIGN PATENT DOCUMENTS 2031500 1/1971 Fed. Rep. of Germany .

*Primary Examiner*—Fred L. Braun

*Attorney, Agent, or Firm*—Cooper & Dunham

[57] ABSTRACT

A developing device including a developing roller having on its surface a layer of developing agent forced against a photosensitive member to perform developing. The developing roller is brought into contact with the photosensitive member under a predetermined pressure when a developing operation is performed, and is brought out of contact with the photosensitive member or kept in contact with the photosensitive member under a pressure lower than the predetermined pressure when no developing operation is performed.

4 Claims, 2 Drawing Sheets

DEVELOPING DEVICE

FIELD OF THE INVENTION

This invention relates to a developing device suitable for use with a copying apparatus, a printer, a facsimile system, etc., which comprises a developing roller holding a layer of developing agent and forcing same against a photosensitive member to develop an electrostatic latent image into a visible image.

RELATED ART STATEMENT

In a developing device of the type described, a non-magnetic toner can be used as a developing agent. This makes it possible for this type of developing device to achieve a clear color tones when it is used with a color copying apparatus. Images developed by this type of developing device can be fixed satisfactorily. Moreover, the need to use an expensive magnet is eliminated, so that a reduction in cost can be realized. This type of developing device offers many advantages. However, some disadvantages are associated with it.

In this type of developing device, a developing roller may be in the form of a resilient roll which may be made as of silicon rubber. In operation, a blade is maintained lightly in contact with the surface of the developing roller and electrically charges a developing agent or a non-magnetic toner that is fed as the developing roller rotates while forming the non-magnetic toner into a thin layer on the surface of the developing roller. The non-magnetic toner is moved by the developing roller to a position in which it is brought into contact with a photosensitive member and made to adhere, by a predetermined pressure applied by the developing roller, to an electrostatic latent image formed on the photosensitive member, to thereby develop the latent image into a visible image.

The material forming the developing roller which is rather soft has a hardness of rubber in the range between 30° and 70° so that a predetermined nip is formed between the developing roller and the photosensitive member when the former presses against the latter under the predetermined pressure. Thus, when the developing roller is maintained in contact with the photosensitive member for a prolonged period of time while remaining inoperative, the surface of the developing roller would undergo deformation. When this phenomenon occurs, it would be impossible to obtain uniform pressure of contact between the developing roller and blade, making it impossible to form a thin layer of toner of uniform thickness on the surface of the developing roller. This would make it impossible to produce a well-defined clear image. The charge carried by the toner adhering to a deformed surface portion of the developing roller would become unstable, and the toner might detach itself from the surface of the developing roller, causing the formation of an ill-defined unclear image. When this trouble occurs, developed images would periodically vary from one another.

SUMMARY OF THE INVENTION

This invention has been developed for the purpose of obviating the aforesaid disadvantages of the prior art. Accordingly, the invention has as its object the provision of a developing device of the type in which developing is performed while the developing roller is maintained in contact with the photosensitive member, which is capable of avoiding deformation of the developing roller and enabling well-defined clear developed images free from variations to be obtained.

The outstanding characteristic of the invention enabling the aforesaid object to be accomplished comprises developing roller support means capable of moving the developing roller between a position in which it is maintained in contact with the photosensitive member and a position in which it is out of contact with the photosensitive member, and pressure applying means applying a predetermined pressure to the developing roller maintained in contact with the photosensitive member to force the developing roller against the photosensitive member. The developing roller is forced by the predetermined pressure against the photosensitive member when the photosensitive member is driven, and the developing roller is brought out of contact with the photosensitive member or maintained in contact therewith by a pressure lower than the predetermined pressure when the photosensitive member is not driven.

DETAILED DESCRIPTION OF THE PREFERRED EMBODIMENT

Figure 1:
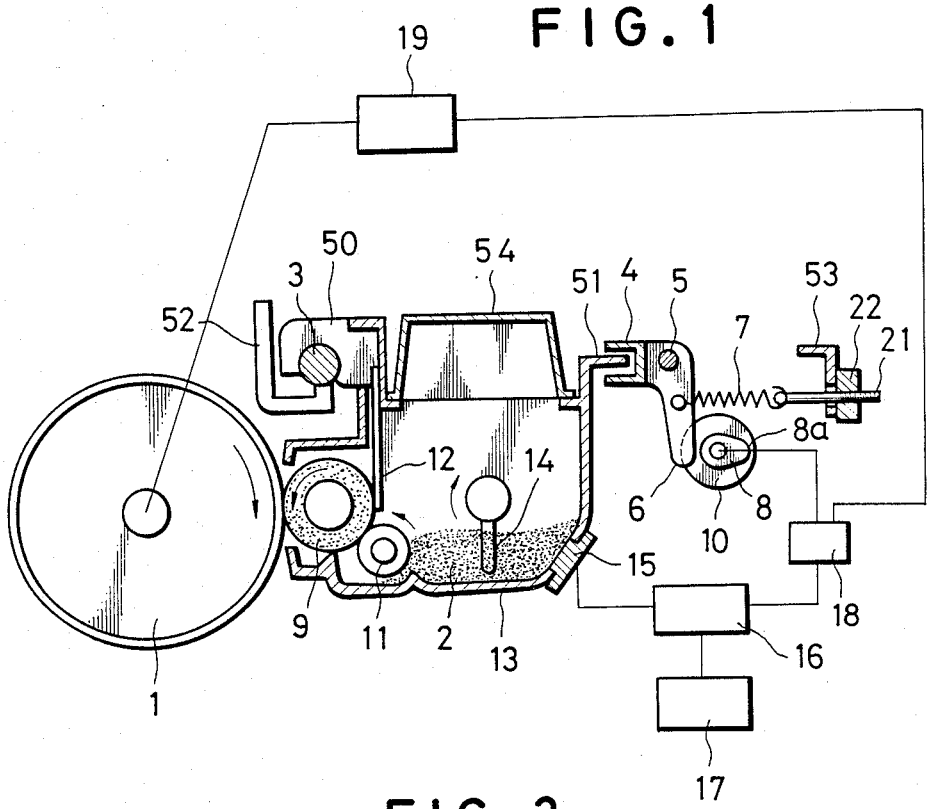
FIG. 1 is a sectional side view of the developing device comprising one embodiment of the invention.

Referring to FIG. 1, a photosensitive member 1 in the form of a drum rotates clockwise and an electrostatic latent image is formed on its surface by the well-known operation of exposing the surface of the photosensitive member 1 to an optical image of a document to be copied. Located on the right side of the photosensitive member 1 is a developing agent container 13 containing a developing agent 2 which may be a non-magnetic one-component toner.

The developing agent 2 is fed to a supply roller 11 as an agitator 14 rotates clockwise and supplied to a developing roller 9 as the supply roller 11 rotates counterclockwise. After being supplied to the developing roller 9, the developing agent 2 moves as the developing roller 9 rotates counterclockwise and is formed into a thin layer of predetermined thickness on the developing roller 9 by the action of a blade 12. The blade 12 which is formed of a thin sheet of metal is maintained at its forward end in contact with the developing roller 9 at a predetermined pressure. Thus, as the developing agent 2 is formed into a thin layer by the action of the blade 12, the developing agent 2 is electrically charged by frictional contact with the blade 12. When the charged developing agent 2 is brought into contact with the surface of the photosensitive member 1, the electrostatic latent image on the surface of the photosensitive member is developed into a visible toner image.

The supply roller 11 and developing roller 9 are maintained in contact with each other and rotate in the same direction as described hereinabove. They rotate at the equal speed of rotation. The supply roller 11 is preferably formed of material, such as polyurethane foam, which is soft and suitable for supporting the developing agent 2. The developing roller 9 includes a surface layer formed of silicon rubber having a hardness of rubber in the range between 30° and 70°. To facilitate application of a bias voltage to the developing roller 9 when developing is performed, carbon particles are scattered and embedded in the surface layer of silicon rubber to impart conductivity thereto.

The supply roller 11 has, in addition to the aforesaid function of supplying the developing agent 2 to the developing roller 9, the function of scraping the residual developing agent 2 from the developing roller 9 after developing is finished.

The peripheral velocity of the developing roller 9 is several times as high as that of the photosensitive member 1.

As can be seen in the foregoing description, the developing roller 9 is maintained in contact with the photosensitive member 1 under a suitable pressure when developing is performed. However, since the developing roller 9 includes a rubber layer of relatively low hardness, the developing roller 9 is preferably kept out of contact with the photosensitive member 1 when no developing operation is performed, to avoid any deformation which the developing roller 9 might undergo. In the developing device according to the invention, there is provided developing roller support means constructed as presently to be described to release the developing roller 9 from engagement with the photosensitive member 1 when no developing operation is performed.

Figure 2:
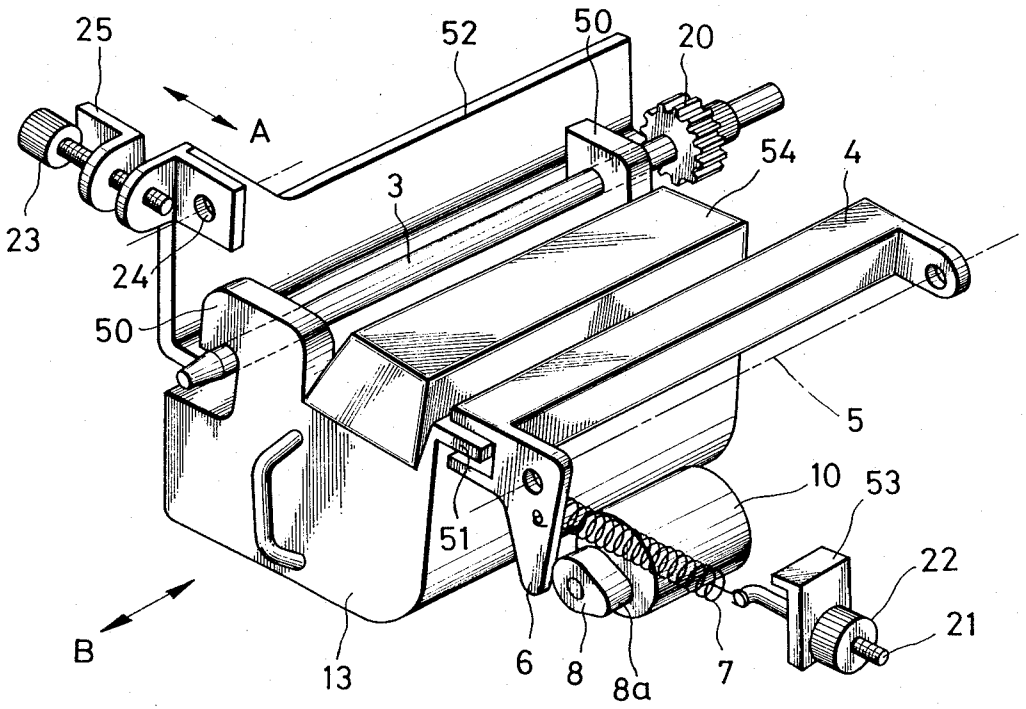
FIG. 2 is a perspective view of the developing device shown in FIG. 1.

Brackets 50 are formed at the left upper portion of the developing agent container 13 and ride on a support shaft 3 for pivotal movement. As shown in FIGS. 1 and 2, the support shaft 3 is secured to a support plate 52 secured to a main body of a copying apparatus, for example, and disposed substantially parallel to the support plate 52. A gear 20 mounted to the support shaft 3 in a position outwardly of one of the brackets 50 is intended to transmit to the developing roller 9 motive force from a drive source, not shown, which is located at the main body.

Since the brackets 50 engage the support shaft 3, the developing agent container 13 and the developing roller 9 located therein move in pivotal movement about the support shaft 3. Thus, as the developing agent container 13 rotates about the support shaft 3, the developing roller 9 is brought into and out of contact with the photosensitive member 1.

Referring to FIG. 1 again, a bent portion 51 is formed at the right upper portion of the developing agent container 13 and engaged in a guide 4, serving as a pivoting member, which has a groove substantially in the form of a letter U in a lying position in cross section. As shown in FIG. 2, the bent portion 51 and guide 4 are substantially parallel to the support shaft 3 and the guide 4 is pivoted at a support shaft 5 substantially parallel to the support shaft 3 (the support shaft 5 not being shown and only its center axis being indicated.) A pressure applying lever 6 is formed integrally with the guide 4 at one end thereof, and a spring 7 is mounted between the pressure applying lever 6 and the main body to serve as pressure applying means.

The guide 4 is urged by the biasing force of the spring 7 to move counterclockwise in FIG. 1 in pivotal movement about the shaft 5. This brings the developing roller 9 into contact with the photosensitive member 9 under a suitable pressure. Developing is performed while the developing roller 9 is being maintained in contact with the photosensitive member 1, as described hereinabove.

Figure 3:
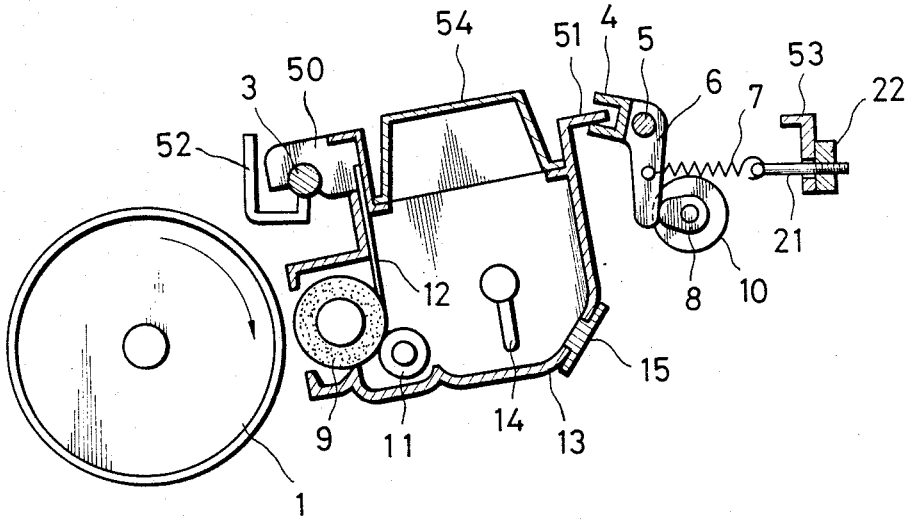
FIG. 3 is a view of the developing device shown in FIGS. 1 and 2, showing the developing roller in a position in which it is out of contact with the photosensitive member.

Located rightwardly of the pressure applying lever 6 is a cam 8 driven by a motor 10 to rotate. When developing is performed or when the developing roller 9 is maintained in contact with the photosensitive member 1 by the biasing force of the spring 7, the cam 8 is out of contact with the pressure applying lever 6 as shown in FIG. 1. When no developing is performed, the motor 10 rotates through 180 degrees to cause a projection 8a of the cam 8 to press against the pressure applying lever 6 to move the latter clockwise as shown in FIG. 3.

The clockwise rotation of the pressure applying lever 6 causes the guide 4 to push the bent portion 51 of the developing agent container 13 upwardly, so that the latter rotates counterclockwise about the support shaft 3. As a result, the developing roller 9 is brought out of contact with the photosensitive member 1 and released from the condition in which pressure is applied thereto. Thus, deformation of the developing roller 9 is avoided.

That the developing roller 9 is prevented from undergoing deformation means that the thin layer of developing agent 2 formed on the surface of the developing roller 9 can have a uniform thickness at all time. This makes it possible to develop the electrostatic latent image on the photosensitive member 1 into a well-defined clear visible image.

The developing roller 9 may be brought out of contact with the photosensitive member 1 any time so long as a developing operation is not performed. Generally, the photosensitive member 1 is driven for rotation when a developing operation is performed, and is not driven when no developing operation is performed. Thus, the developing roller 9 may be set such that it is released from contact with the photosensitive member 1 when the latter is not driven. Releasing the developing roller 9 from contact with the photosensitive member 1 may be timed as presently to be described.

First, the developing roller 9 may be released from contact with the photosensitive member 1 as the volume of the developing agent 2 in the developing agent container 13 decreases. A toner depletion sensor 15 is located at the right lower portion of the developing agent container 13 as shown in FIG. 1 and monitors the volume of the developing agent 2 in the container 13. When the volume of the developing agent 2 falls below a predetermined level, the sensor 15 produces a signal. The sensor 15 may be in the form of a piezoelectric element or an optical sensor. Also, the torque produced by the rotation of the agitator 14 may be relied on for sensing the depletion of the developing agent 2.

The signal produced by the sensor 15 is supplied to a counter circuit 16 and indicated by a warning indication circuit 17. After receiving the signal from the sensor 15, the counter circuit 16 counts a predetermined number of prints or a predetermined period of time and then produces a signal for driving the motor 10 which is supplied to a cam motor drive circuit 18. Upon receipt of the signal, the cam motor drive circuit 18 rotates the cam 8 to a predetermined position (see FIG. 3), to bring the developing roller 9 out of contact with the photosensitive member 1 and keep same in the released position.

As a fresh supply of developing agent 2 is delivered to the developing agent container 13 from a cartridge 54, the toner depletion sensor 15 stops producing the signal, and the motor 10 rotates again through a predetermined angle (180 degrees in the embodiment shown and described) while the cam 8 stops in a predetermined position in which it is out of contact with the pressure applying lever 6. As a result, the developing roller 9 is brought into contact with the photosensitive member 1 again to enable a developing operation to be performed.

A second process for timing the release of the developing roller from contact with the photosensitive member 1 is as follows. The operation of the photosensitive member 1 is controlled by a photosensitive member control circuit 19 which receives a command from a central control unit, not shown, which controls the operation of the apparatus using the developing device according to the invention, such as a copying apparatus, a printer, etc., to control the operation of the photosensitive member 1. When the operator performs a copying operation by the copying apparatus or a printing operation by the printer, a main switch, not shown, is depressed to cause the central control unit to send commands to all the parts of the apparatus to start operation. At this time, a command is also given to the photosensitive member control circuit 19. Upon receipt of the command, the control circuit 19 outputs a signal for commencing a copying or printing operation to the photosensitive member 1. Thus, the photosensitive member 1 is driven for rotation based on the signal to start a copying or printing operation. When the copying or printing operation is finished, a copying or printing finishing signal is produced by the control circuit 19 based on a command from the central control unit, and the photosensitive member 1 is rendered inoperative based on this signal.

When a copying or printing commencing signal is produced by the control circuit 19, the signal is supplied to the cam motor drive circuit 18 to drive the cam 8, in addition to driving the photosensitive member 1 for rotation. This moves the cam 8 from the position shown in FIG. 3 to the position shown in FIG. 1, to bring the developing roller 9 in contact with the photosensitive member 1 to enable a developing operation to be performed. When a copying or printing terminating signal is produced, the cam 8 is rotated again to the position shown in FIG. 3, thereby bringing the developing roller 9 out of contact with the photosensitive member 1.

A third process for timing the release of the developing roller 9 from contact with the photosensitive member is as follows. In this process, the cam 8 is rotated in timed relation to the operation of turning on and off the power source for driving the apparatus, such as a copying apparatus, not in timed relation to the driving of the photosensitive member (or a copying or printing signal) as is the case with the second process. When the third process is used, the cam 8 is moved to the position shown in FIG. 1 when the power source is turned on to bring the developing roller 9 into contact with the photosensitive member 1. The cam 8 is further rotated when the power source is turned off, to bring the developing roller 9 out of contact with the photosensitive member 1. A capacitor may be used to back up the cam motor drive circuit 18 in driving the cam 8 and hence the motor 10.

The pressure at which the developing roller 9 is maintained in contact with the photosensitive member 1 may be controlled to a desired level by adjusting a rod screw 21 supporting one end of the spring 7 and a thumbscrew 22 fitted over the rod screw 21.

To render uniform the distribution of pressure axially of the developing roller 9, the support plate 52 to which the support shaft 3 is secured is connected at its left end portion as seen in FIG. 2 to the main body through a thumbscrew 23 and an angle member 25 supporting the thumbscrew 23. By virtue of this arrangement, when the thumbscrew 23 is turned, it is possible to move the left end portion of the support plate 52 at a right angle to the support shaft 3, as indicated by arrows A, to thereby compensate for any variation in the size of parts. The reference numeral 24 designates a hole for securing the support plate 52 in place after the thumbscrew 23 is manipulated. The right end portion of the support plate 52 is pivotally supported by the main body, so that the left end of the support shaft 3 can be moved toward and away from the photosensitive member 1.

In FIG. 3, the developing roller 9 is shown as being completely brought out of contact with the photosensitive member 1. However, it is not essential that the developing roller 9 be completely brought out of contact with the photosensitive member 1. The deformation of the developing roller 9 could be avoided by keeping the pressure at which the developing roller 9 contacts the photosensitive member 1 at a level lower than a predetermined level without requiring to completely separate them from each other, depending on the material used for forming the developing roller 9. In this case, the developing roller 9 may be kept, when no developing operation is performed, in contact with the photosensitive member 1 at a pressure lower than the pressure at which it is kept in contact with the photosensitive member 1 when a developing operation is performed.

The cam 8 is preferably shaped to have a suitable easement curve to enable the developing roller 9 to come into contact with the photosensitive member 1 smoothly without contacting same with a jerk. This makes it possible to avoid the application of an impact of shock to the photosensitive member 1 and to prevent the developing agent 2 from scattering when the developing roller 9 is brought into contact with the photosensitive member 1.

In the embodiment shown and described hereinabove, the brackets 50 merely ride on the support shaft 3 and the bent portion 51 is capable of mevement along the groove of the guide 4. Thus, the developing agent container 13 can be detachably attached to the main body together with the developing roller 9 and other parts contained therein, as it is moved in the direction of arrows B along the axis of the photosensitive member 1.

The cam 8 has been shown and described as being driven by the motor 10. However, the invention is not limited to this specific means for driving the cam 8, and drive connection means, such as rotary solenoid means or clutch means connected to the photosensitive member drive system, that enables the cam 8 to stop in two positions, can be used for driving the cam 8.

What is claimed is:

1. A developing device comprising a developing roller having on its surface a developing agent layer which can be forced against a photosensitive member to perform a developing operation, wherein the improvement comprises:

(a) developing roller support means (3, 50, 13, 51, 6) supporting the developing roller and capable of moving the developing roller between a position in which it is maintained in contact with the photosensitive member and a position in which it is out of contact with the photosensitive member;

(b) pressure applying means (7) applying pressure to the developing roller to force the developing roller toward the photosensitive member;

(c) control means (10, 8, 18) which automatically brings the developing roller into contact with the photosensitive member under a predetermined pressure when a developing operation is being carried out and, when no developing operation is being carried out, automatically brings the developing roller into a selected one of (i) a position in which the developing roller is out of contact with the photosensitive member and (ii) a position in which the developing roller is in contact with the photosensitive member but under a pressure which is lower than said predetermined pressure; and (d) pressure adjust means (21, 22, 53) adjusting the pressure applied from the developing roller to the photosensitive member;

wherein said pressure applying means comprises a spring (7) forcing said developing roller against said photosensitive member, and said pressure adjust means adjusts the biasing force of said spring.

2. A developing device as in claim 1, wherein said developing roller support means comprises a support shaft (3) located parallel to the photosensitive member, a developing agent container (13) pivotally supported by said support shaft and supporting the developing roller, and a pivoting member (a pressure applying lever 6) engaging the developing agent container for pivotally moving same, wherein the developing roller can be brought into and out of contact with the photosensitive member as the developing agent container (13) is moved in pivotal movement by the action of said pivoting member.

3. A develping device as in claim 1 in which said pressure adust means comprises a rod screw (21) fixed to one end of said spring, and a thumbscrew (22) fitted over said rod screw.

4. A developing device comprising a developing roller having on its surface a developing agent layer forced against a photosensitive member to perform a developing operation, wherein the improvement comprises:

(a) developing roller support means (3, 50, 13, 51, 6) supporting the developing roller capable of moving the developing roller between a position in which it is maintained in contact with the photosensitive member and a position in which it is out of contact with the photosensitive member;

(b) pressure applying means (7) applying a predetermined pressure to the developing roller maintained in contact with the photosensitive member to force the developing roller against the photosensitive member;

(c) control means (10, 8, 18) automatically bringing the developing roller into contact with the photosensitive member under the predetermined pressure when the developing operation is performed and automatically bringing the developing roller out of contact with the photosensitive member or keeping the developing roller in contact with the photosensitive member under a pressure lower than the predetermined pressure when no developing operation is performed; and (d) pressure adjust means (21, 22, 53) adjusting the pressure applied from the developing roller to the photosensitive member;

wherein said developing roller support means comprises a support shaft (3) located parallel to the photosensitive member, a developing agent container (13) pivotally supported by said support shaft and supporting the developing roller, and a pivoting member (pressure applying lever 6) engaging the developing agent container for pivotally moving same, whereby the developing roller can be brought into and out of contact with the photosensitive member as the developing agent container (13) is moved in pivotal movement by the action of said pivoting member; and including means for rendering uniform the distribution of pressure axially of the developing roller against the photosensitive member which comprises means (23, 52) for moving one end of said support shaft toward and away from said photosensitive member, and support means (lines 1–2, page 13) pivotally supporting the other end of said support shaft.

* * * * *